US009982564B2

(12) United States Patent
Yeager et al.

(10) Patent No.: US 9,982,564 B2
(45) Date of Patent: May 29, 2018

(54) TURBINE FRAME ASSEMBLY AND METHOD OF DESIGNING TURBINE FRAME ASSEMBLY

(71) Applicant: United Technologies Corporation, Hartford, CT (US)

(72) Inventors: William Yeager, Jupiter, FL (US); Jonathan Ariel Scott, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 283 days.

(21) Appl. No.: 14/654,953

(22) PCT Filed: Dec. 11, 2013

(86) PCT No.: PCT/US2013/074278

§ 371 (c)(1),
(2) Date: Jun. 23, 2015

(87) PCT Pub. No.: WO2014/105425

PCT Pub. Date: Jul. 3, 2014

(65) Prior Publication Data

US 2015/0345338 A1 Dec. 3, 2015

Related U.S. Application Data

(60) Provisional application No. 61/747,271, filed on Dec. 29, 2012, provisional application No. 61/776,393, filed on Mar. 11, 2013.

(51) Int. Cl.
*F01D 25/16* (2006.01)
*F01D 25/26* (2006.01)
(Continued)

(52) U.S. Cl.
CPC ..... *F01D 25/162* (2013.01); *F01D 25/145* (2013.01); *F01D 25/26* (2013.01);
(Continued)

(58) Field of Classification Search
CPC ..... F01D 25/162; F05D 2240/15
See application file for complete search history.

(56) References Cited

U.S. PATENT DOCUMENTS 2,214,108 A 7/1938 Grece
2,869,941 A * 1/1959 Shoup, Jr. ..... F01D 25/164 384/581

(Continued)

FOREIGN PATENT DOCUMENTS

WO WO 03/020469 A1 3/2003
WO WO 2006/007686 A1 1/2006

(Continued)

OTHER PUBLICATIONS

International Searching Authority, PCT Notification of Transmittal of the International Search Report and the Written Opinion, dated Mar. 25, 2014, 10 pages.

*Primary Examiner* — Ninh H Nguyen
*Assistant Examiner* — Topaz L Elliott
(74) *Attorney, Agent, or Firm* — Kinney & Lange, P.A.

(57) ABSTRACT

A structural case assembly comprises a frame, fairing and heat shield. The frame is fabricated from a material having a temperature limit below an operating point of a gas turbine engine, and comprises an outer ring, an inner ring and a plurality of struts extending therebetween to define a flow path. The fairing is fabricated from a material having a temperature limit above the operating point of the gas turbine engine, and comprises a ring-strut-ring structure that lines the flow path. The heat shield is disposed between the frame and the fairing to inhibit radiant heat transfer ther-
(Continued)

ebetween. The heat shield may block all line-of-sight between the fairing and the frame. The frame may be produced from CA-6NM alloy. A method for designing a turbine case structure includes selecting a frame material having a temperature limit below the operating point of an engine.

20 Claims, 6 Drawing Sheets

(51) Int. Cl.
*F01D 25/14* (2006.01)
*F01D 25/30* (2006.01)

(52) U.S. Cl.
CPC ..... *F01D 25/30* (2013.01); *F05D 2220/32* (2013.01); *F05D 2230/00* (2013.01); *F05D 2240/15* (2013.01); *F05D 2260/231* (2013.01); *F05D 2300/171* (2013.01); *F05D 2300/175* (2013.01); *Y10T 29/49321* (2015.01)

(56) References Cited

U.S. PATENT DOCUMENTS 2,928,648 A * 3/1960 Haines ..... F01D 9/065 384/418
3,576,328 A 4/1971 Vose
3,802,046 A 4/1974 Wachtell et al.
3,970,319 A 7/1976 Carroll et al.
4,009,569 A 3/1977 Kozlin
4,044,555 A 4/1977 McLoughlin et al.
4,088,422 A 5/1978 Martin
4,114,248 A 9/1978 Smith et al.
4,305,697 A 12/1981 Cohen et al.
4,321,007 A 3/1982 Dennison et al.
4,369,016 A 1/1983 Dennison
4,478,551 A 10/1984 Honeycutt, Jr. et al.
4,544,420 A 10/1985 Montgomery
4,645,217 A 2/1987 Honeycutt, Jr. et al.
4,678,113 A 7/1987 Bridges et al.
4,738,453 A 4/1988 Ide
4,756,536 A 7/1988 Belcher
4,793,770 A 12/1988 Schonewald et al.
4,920,742 A 5/1990 Nash et al.
4,987,736 A 1/1991 Ciokajlo et al.
4,989,406 A 2/1991 Vdoviak et al.
4,993,918 A 2/1991 Myers et al.
5,031,922 A 7/1991 Heydrich
5,042,823 A 8/1991 Mackay et al.
5,071,138 A 12/1991 Mackay et al.
5,076,049 A 12/1991 VonBenken et al.
5,100,158 A 3/1992 Gardner
5,108,116 A 4/1992 Johnson et al.
5,169,159 A 12/1992 Pope et al.
5,174,584 A 12/1992 Lahrman
5,188,507 A 2/1993 Sweeney
5,211,541 A 5/1993 Fledderjohn et al.
5,236,302 A 8/1993 Weisgerber et al.
5,246,295 A 9/1993 Ide
5,265,807 A 11/1993 Steckbeck et al.
5,269,057 A 12/1993 Mendham
5,272,869 A 12/1993 Dawson et al.
5,273,397 A 12/1993 Czachor et al.
5,292,227 A 3/1994 Czachor et al.
5,312,227 A 5/1994 Grateau et al.
5,338,154 A 8/1994 Meade et al.
5,357,744 A 10/1994 Czachor et al.
5,370,402 A 12/1994 Gardner et al.
5,385,409 A 1/1995 Ide
5,401,036 A 3/1995 Basu
5,438,756 A 8/1995 Halchak et al.
5,474,305 A 12/1995 Flower
5,483,792 A 1/1996 Czachor et al.
5,558,341 A 9/1996 McNickle et al.
5,597,286 A 1/1997 Dawson et al.
5,605,438 A 2/1997 Burdgick et al.
5,609,467 A 3/1997 Lenhart et al.
5,632,493 A 5/1997 Gardner
5,634,767 A 6/1997 Dawson
5,691,279 A 11/1997 Tauber et al.
5,755,445 A 5/1998 Arora
5,851,105 A 12/1998 Fric et al.
5,911,400 A 6/1999 Niethammer et al.
6,163,959 A 12/2000 Arraitz et al.
6,196,550 B1 3/2001 Arora et al.
6,227,800 B1 5/2001 Spring et al.
6,337,751 B1 1/2002 Kimizuka
6,343,912 B1 2/2002 Mangeiga et al.
6,358,001 B1 3/2002 Bosel et al.
6,364,316 B1 4/2002 Arora
6,439,841 B1 8/2002 Bosel
6,511,284 B2 1/2003 Darnell et al.
6,578,363 B2 6/2003 Hashimoto et al.
6,601,853 B2 8/2003 Inoue
6,612,807 B2 9/2003 Czachor
6,619,030 B1 9/2003 Seda et al.
6,638,013 B2 10/2003 Nguyen et al.
6,652,229 B2 11/2003 Lu
6,672,833 B2 1/2004 MacLean et al.
6,719,524 B2 4/2004 Nguyen et al.
6,736,401 B2 5/2004 Chung et al.
6,792,758 B2 9/2004 Dowman
6,796,765 B2 9/2004 Kosel et al.
6,805,356 B2 10/2004 Inoue
6,811,154 B2 11/2004 Proctor et al.
6,935,631 B2 8/2005 Inoue
6,969,826 B2 11/2005 Trewiler et al.
6,983,608 B2 1/2006 Allen, Jr. et al.
7,055,305 B2 6/2006 Baxter et al.
7,094,026 B2 8/2006 Coign et al.
7,100,358 B2 9/2006 Gekht et al.
7,200,933 B2 4/2007 Lundgren et al.
7,229,249 B2 6/2007 Durocher et al.
7,238,008 B2 7/2007 Bobo et al.
7,367,567 B2 5/2008 Farah et al.
7,371,044 B2 5/2008 Nereim
7,389,583 B2 6/2008 Lundgren
7,614,150 B2 11/2009 Lundgren
7,631,879 B2 12/2009 Diantonio
7,673,461 B2 3/2010 Cameriano et al.
7,677,047 B2 3/2010 Somanath et al.
7,735,833 B2 6/2010 Braun et al.
7,798,768 B2 9/2010 Strain et al.
7,815,417 B2 10/2010 Somanath et al.
7,824,152 B2 11/2010 Morrison
7,891,165 B2 2/2011 Bader et al.
7,909,573 B2 3/2011 Cameriano et al.
7,955,446 B2 6/2011 Dierberger
7,959,409 B2 6/2011 Guo et al.
7,988,799 B2 8/2011 Dierberger
8,069,648 B2 12/2011 Snyder et al.
8,083,465 B2 * 12/2011 Herbst ..... B23P 6/005 29/402.11
8,083,471 B2 * 12/2011 Black ..... F01D 25/162 415/134
8,091,371 B2 1/2012 Durocher et al.
8,092,161 B2 1/2012 Cai et al.
8,152,451 B2 4/2012 Manteiga et al.
8,162,593 B2 4/2012 Guimbard et al.
8,172,526 B2 5/2012 Lescure et al.
8,177,488 B2 5/2012 Manteiga et al.
8,221,071 B2 7/2012 Wojno et al.
8,245,399 B2 8/2012 Anantharaman et al.
8,245,518 B2 8/2012 Durocher et al.
8,266,914 B2 9/2012 Hawie et al.
8,282,342 B2 10/2012 Tonks et al.
8,371,127 B2 2/2013 Durocher et al.
8,371,812 B2 2/2013 Manteiga et al.
8,500,392 B2 * 8/2013 Durocher ..... F01D 9/06 415/116
8,616,835 B2 * 12/2013 Hashimoto ..... F01D 9/065 415/142

(56) References Cited

U.S. PATENT DOCUMENTS

| | | | | |
|---|---|---|---|---|
| 9,212,567 | B2 * | 12/2015 | Rauch | F01D 25/30 |
| 9,316,153 | B2 * | 4/2016 | Patat | F01D 9/02 |
| 2003/0025274 | A1 | 2/2003 | Allan et al. | |
| 2003/0042682 | A1 | 3/2003 | Inoue | |
| 2003/0062684 | A1 | 4/2003 | Inoue | |
| 2003/0062685 | A1 | 4/2003 | Inoue | |
| 2005/0046113 | A1 | 3/2005 | Inoue | |
| 2006/0010852 | A1 | 1/2006 | Gekht et al. | |
| 2008/0216300 | A1 | 9/2008 | Anderson et al. | |
| 2010/0132371 | A1 | 6/2010 | Durocher et al. | |
| 2010/0132374 | A1 | 6/2010 | Manteiga et al. | |
| 2010/0132377 | A1 | 6/2010 | Durocher et al. | |
| 2010/0202872 | A1 | 8/2010 | Weidmann | |
| 2010/0236244 | A1 | 9/2010 | Longardner | |
| 2010/0275572 | A1 | 11/2010 | Durocher et al. | |
| 2010/0275614 | A1 | 11/2010 | Fontaine et al. | |
| 2010/0307165 | A1 | 12/2010 | Wong et al. | |
| 2011/0000223 | A1 | 1/2011 | Russberg | |
| 2011/0005234 | A1 | 1/2011 | Hashimoto et al. | |
| 2011/0020116 | A1 * | 1/2011 | Hashimoto | F01D 9/065 415/180 |
| 2011/0061767 | A1 | 3/2011 | Vontell et al. | |
| 2011/0081237 | A1 * | 4/2011 | Durocher | F01D 9/06 415/173.1 |
| 2011/0081239 | A1 | 4/2011 | Durocher | |
| 2011/0081240 | A1 | 4/2011 | Durocher et al. | |
| 2011/0085895 | A1 | 4/2011 | Durocher et al. | |
| 2011/0214433 | A1 | 9/2011 | Feindel et al. | |
| 2011/0262277 | A1 | 10/2011 | Sjoqvist et al. | |
| 2011/0302929 | A1 | 12/2011 | Bruhwiler | |
| 2012/0111023 | A1 | 5/2012 | Sjoqvist et al. | |
| 2012/0156020 | A1 | 6/2012 | Kottilingam et al. | |
| 2012/0186254 | A1 | 7/2012 | Ito et al. | |
| 2012/0204569 | A1 | 8/2012 | Schubert | |
| 2013/0011242 | A1 | 1/2013 | Beeck et al. | |
| 2013/0055725 | A1 * | 3/2013 | Rauch | F01D 25/30 60/796 |
| 2014/0205447 | A1 * | 7/2014 | Patat | F01D 9/065 415/177 |
| 2014/0286763 | A1 * | 9/2014 | Munshi | F02C 7/12 415/178 |

FOREIGN PATENT DOCUMENTS

| | | | |
|---|---|---|---|
| WO | WO 2009/157817 | A1 | 12/2009 |
| WO | WO 2010/002295 | A1 | 1/2010 |
| WO | WO 2012/158070 | A1 | 11/2012 |

* cited by examiner

TURBINE FRAME ASSEMBLY AND METHOD OF DESIGNING TURBINE FRAME ASSEMBLY

BACKGROUND

The present disclosure relates generally to gas turbine engine load bearing cases. More particularly, the present disclosure relates to methods for designing systems for protecting load bearing structural frames from heat exposure.

Turbine Exhaust Cases (TEC) typically comprise structural frames that support the very aft end of a gas turbine engine. In aircraft applications, the TEC can be utilized to mount the engine to the aircraft airframe. In industrial gas turbine applications, the TEC can be utilized to couple the gas turbine engine to an electrical generator. A typical TEC comprises an outer ring that couples to the outer diameter case of the low pressure turbine, an inner ring that surrounds the engine centerline so as to support shafting in the engine, and a plurality of struts connecting the inner and outer rings. As such, the TEC is typically subject to various types of loading, thereby requiring the TEC to be structurally strong and rigid. Due to the placement of the TEC within the hot gas stream exhausted from a combustor of the gas turbine engine, it is typically desirable to shield the TEC structural frame with a fairing that is able to withstand direct impingement of the hot gases for a prolonged period of time. The fairing additionally takes on a ring-strut-ring configuration wherein the struts are hollow to surround the frame struts. Such a fairing is described in U.S. Pat. No. 4,993,918 to Myers et al., which is assigned to United Technologies Corporation. Due to increased engine efficiencies achieved at higher engine operating temperatures, it is desirable to have the TEC capable of withstanding elevated temperatures. It is also, however, desirable to minimize expense of the TEC without sacrificing performance.

SUMMARY

The present disclosure is directed to a structural case assembly, such as a turbine exhaust case. The turbine exhaust case comprises a frame, a fairing and a heat shield. The frame is fabricated from a material having a temperature limit below an operating point of a gas turbine engine. The frame comprises an outer ring, an inner ring and a plurality of struts joining the outer ring and the inner ring to define a load path between the outer ring and the inner ring. The fairing is fabricated from a material having a temperature limit above the operating point of the gas turbine engine. The fairing comprises a ring-strut-ring structure that lines the flow path. The heat shield is disposed between the frame and the fairing to inhibit radiant heat transfer between the frame and the fairing. In one embodiment, the heat shield blocks all line-of-sight between the fairing and the frame. In another embodiment, the frame is produced from CA-6NM alloy.

In another embodiment, the present disclosure is directed to a method for designing a case structure including a heat shield that is disposed between a frame and a fairing. The method comprises determining a temperature element of an engine operating point for a gas turbine engine. The frame material is selected to be not capable of withstanding the temperature element. The fairing material is selected to be capable of withstanding the temperature element. A temperature gradient is determined between the fairing and the frame. A heat shield material is selected having a shield temperature limit capable of withstanding the temperature gradient.

DETAILED DESCRIPTION

Figure 1:
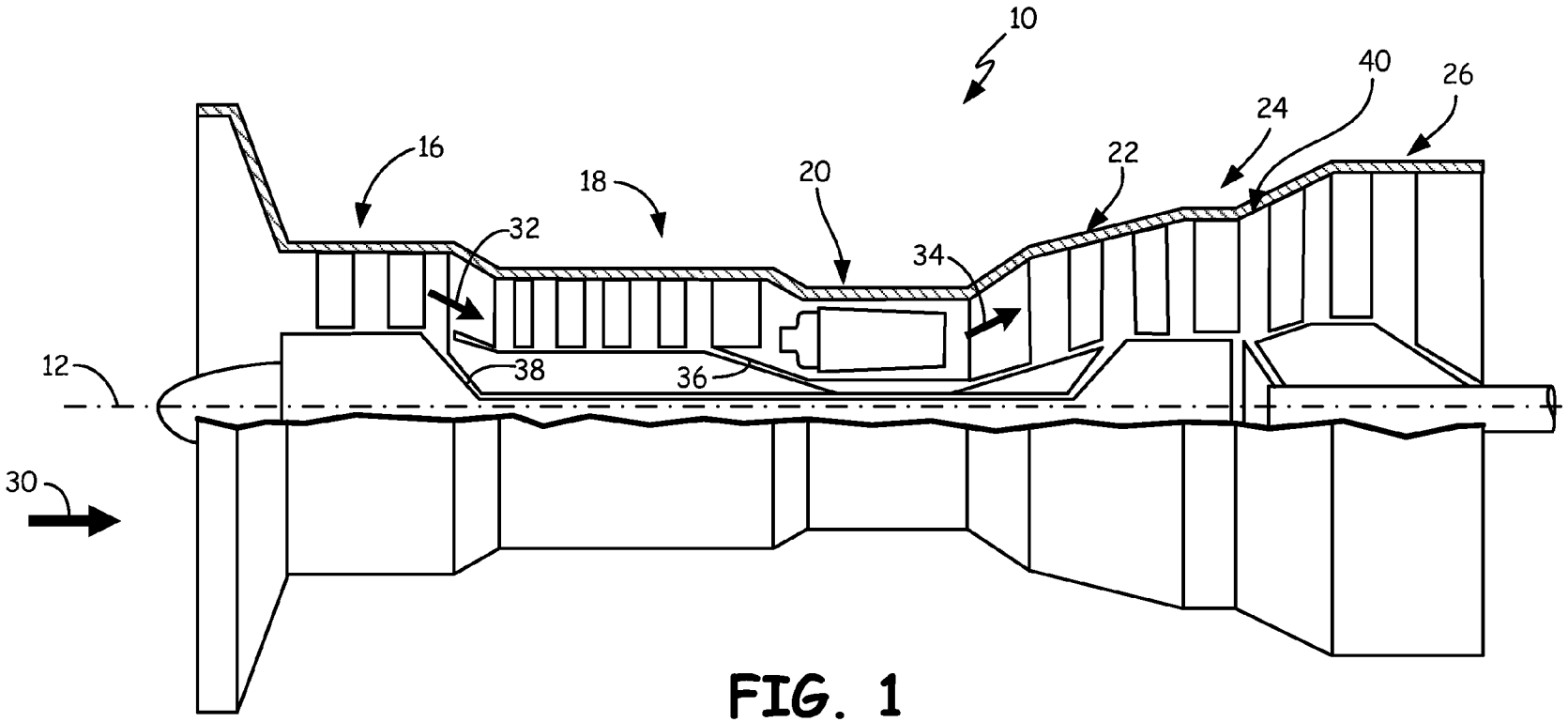
FIG. 1 is a side sectional schematic view of an industrial gas turbine engine having a turbine exhaust case.

FIG. 1 is a side partial sectional schematic view of gas turbine engine 10. In the illustrated embodiment, gas turbine engine 10 is an industrial gas turbine engine circumferentially disposed about a central, longitudinal axis or axial engine centerline axis 12 as illustrated in FIG. 1. Gas turbine engine 10 includes, in series order from front to rear, low pressure compressor section 16, high pressure compressor section 18, combustor section 20, high pressure turbine section 22, and low pressure turbine section 24. In some embodiments, power turbine section 26 is a free turbine section disposed aft of the low pressure turbine 24.

As is well known in the art of gas turbines, incoming ambient air 30 becomes pressurized air 32 in the low and high pressure compressor sections 16 and 18. Fuel mixes with pressurized air 32 in combustor section 20, where it is burned. Once burned, combustion gases 34 expand through high and low pressure turbine sections 22 and 24 and through power turbine section 26. High and low pressure turbine sections 22 and 24 drive high and low pressure rotor shafts 36 and 38 respectively, which rotate in response to flow of combustion gases 34 and thus rotate the attached high and low pressure compressor sections 18 and 16. Power turbine section 26 may, for example, drive an electrical generator, pump, or gearbox (not shown).

Low Pressure Turbine Exhaust Case (LPTEC) 40 is positioned between low pressure turbine section 24 and power turbine section 26. LPTEC 40 defines a flow path for gas exhausted from low pressure turbine section 24 that is conveyed to power turbine 26. LPTEC 40 also provides structural support for gas turbine engine 10 so as to provide a coupling point for power turbine section 26. LPTEC 40 is therefore rigid and structurally strong. The present disclosure relates generally to placement of heat shields between a fairing and a frame within LPTEC 40.

It is understood that FIG. 1 provides a basic understanding and overview of the various sections and the basic operation of an industrial gas turbine engine. It will become apparent to those skilled in the art that the present application is applicable to all types of gas turbine engines, including those with aerospace applications. Similarly, although the present disclosure is described with reference to LPTEC 40, the present disclosure is applicable to other components of gas turbine engines, such as intermediate cases, mid-turbine frames and the like.

Figure 2A:
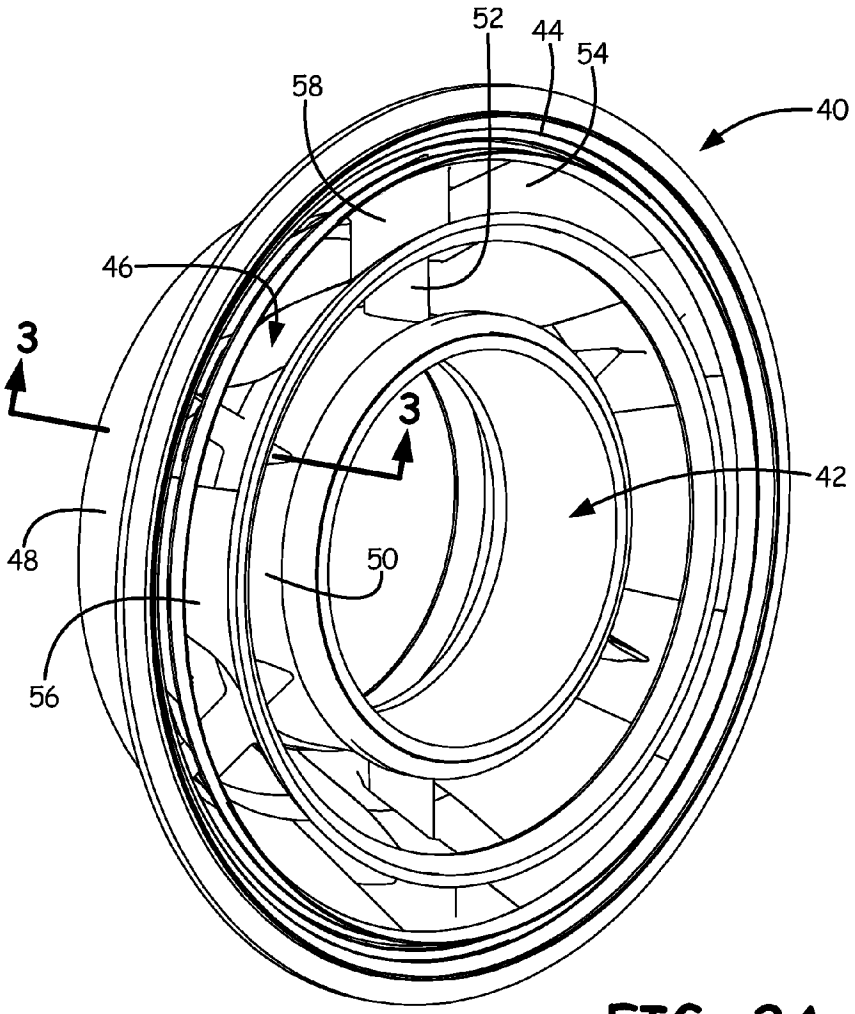
FIG. 2A is a perspective view of a turbine exhaust case in which a ring-strut-ring fairing is assembled with a ring-strut-ring frame.
Figure 2B:
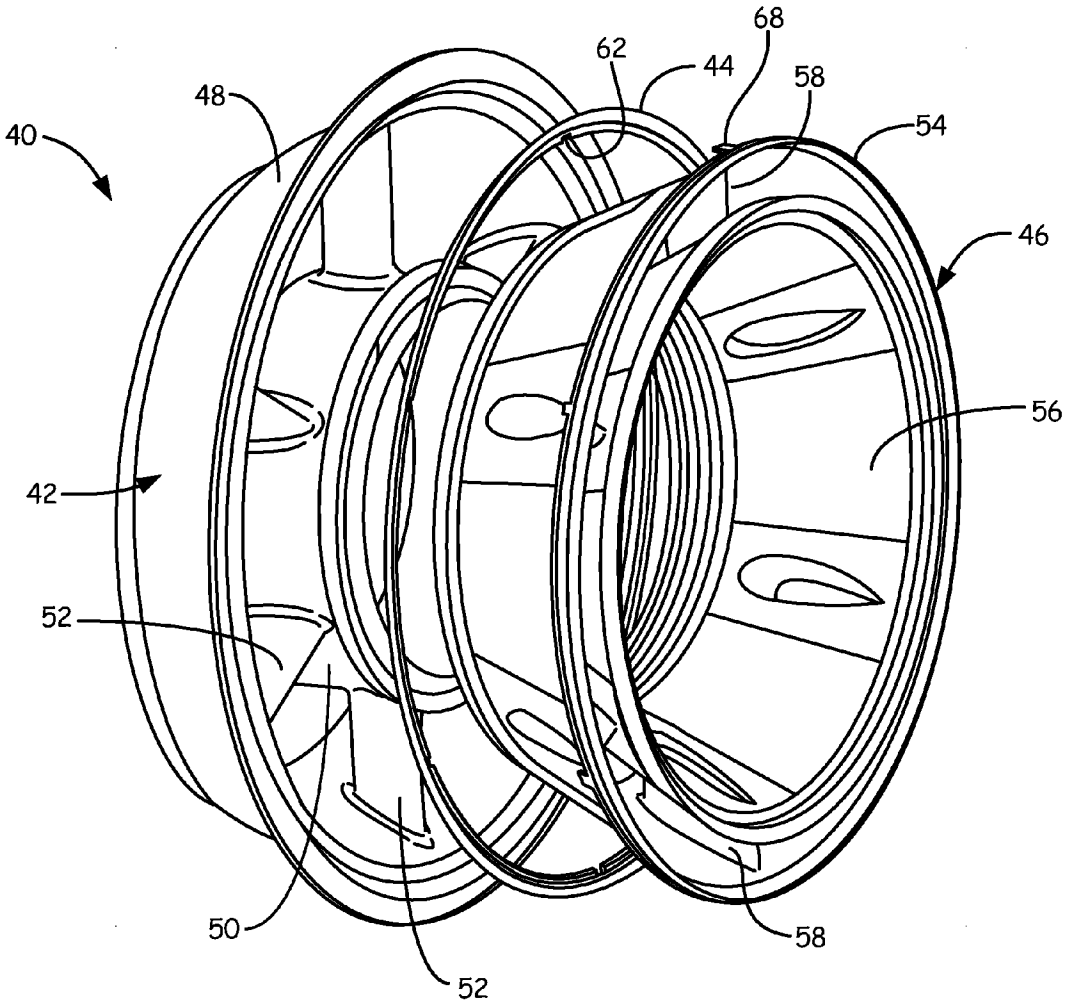
FIG. 2B is an exploded view of the turbine exhaust case of FIG. 2A showing the frame and the fairing.

FIG. 2A shows a perspective view of Low Pressure Turbine Exhaust Case (LPTEC) 40, which includes frame 42, annular mount 44, and fairing 46. FIG. 2B, which is discussed concurrently with FIG. 2A, shows an exploded view of LPTEC 40 showing annular mount 44 disposed between fairing 46 and frame 42. Frame 42 includes outer ring 48, inner ring 50, and struts 52. Fairing 46 includes outer ring 54, inner ring 56, and vanes 58.

Frame 42 comprises a ring-strut-ring structure that defines a load path between outer ring 48 and inner ring 50. Fairing 46 comprises a ring-strut-ring structure that is mounted within frame 42 to define a gas path and protect frame 42 from high temperature exposure. In one embodiment, fairing 46 can be built around frame 42, and in another embodiment, frame 42 is built within fairing 46.

Frame 42 comprises a stator component of gas turbine engine 10 (FIG. 1) that is typically mounted between low pressure turbine section 24 and power turbine section 26. In the embodiment shown, outer ring 48 of frame 42 is conically shaped, while inner ring 50 is cylindrically shaped. Outer ring 48 is connected to inner ring 50 via struts 52. Outer ring 48, inner ring 50 and struts 52 form a portion of the load path through gas turbine engine 10 (FIG. 1). Specifically, outer ring 48 defines the outer radial boundary of a load path between low pressure turbine section 24 and power turbine section 26 (FIG. 1).

Fairing 46 is adapted to be disposed within frame 42 between outer ring 48 and inner ring 50 to form the annular flow path. Outer ring 54 and inner ring 56 of fairing 46 have generally conical shapes, and are connected to each other by vanes 58, which act as struts to join rings 54 and 56. Outer ring 54, inner ring 56, and vanes 58, form the gas flow path through frame 42. Specifically, vanes 58 encase struts 52, while outer ring 54 and inner ring 56 line the inward facing (toward centerline axis 12 of FIG. 1) surface of outer ring 48 and outward facing surface of inner ring 50, respectively.

In one embodiment, annular mount 44 is interposed between frame 42 and fairing 46 and is configured to prevent circumferential rotation of fairing 46 within frame 42. In one embodiment, annular mount 44 comprises a crenellated, full circumferential stop ring, that is adapted to be affixed to an axial end of outer ring 48. Fairing 46 engages annular mount 44 when installed within frame 42. Fairing 46 and annular mount 44 have mating anti-deflection features, such as slots 62 and lugs 68, that engage each other to prevent circumferential movement of fairing 46 relative to the frame 42. Specifically, lugs 68 extend axially into slots 62 to prevent circumferential rotation of fairing 46, while permitting radial and axial movement of fairing 46 relative to frame 42.

As will be discussed in greater detail with reference to FIG. 3, frame 42 is designed so as to provide a structural load-bearing path within engine 10 (FIG. 1) and is made of a strong, cost efficient material. Fairing 46 is designed to survive direct impingement of combustion gases 34 and is made of a more expensive, heat resistant material. A heat shield can be positioned between frame 42 and fairing 46 to protect frame 42 against radiant heat exposure from fairing 46, as will be discussed later with reference to FIG. 4.

Figure 3:
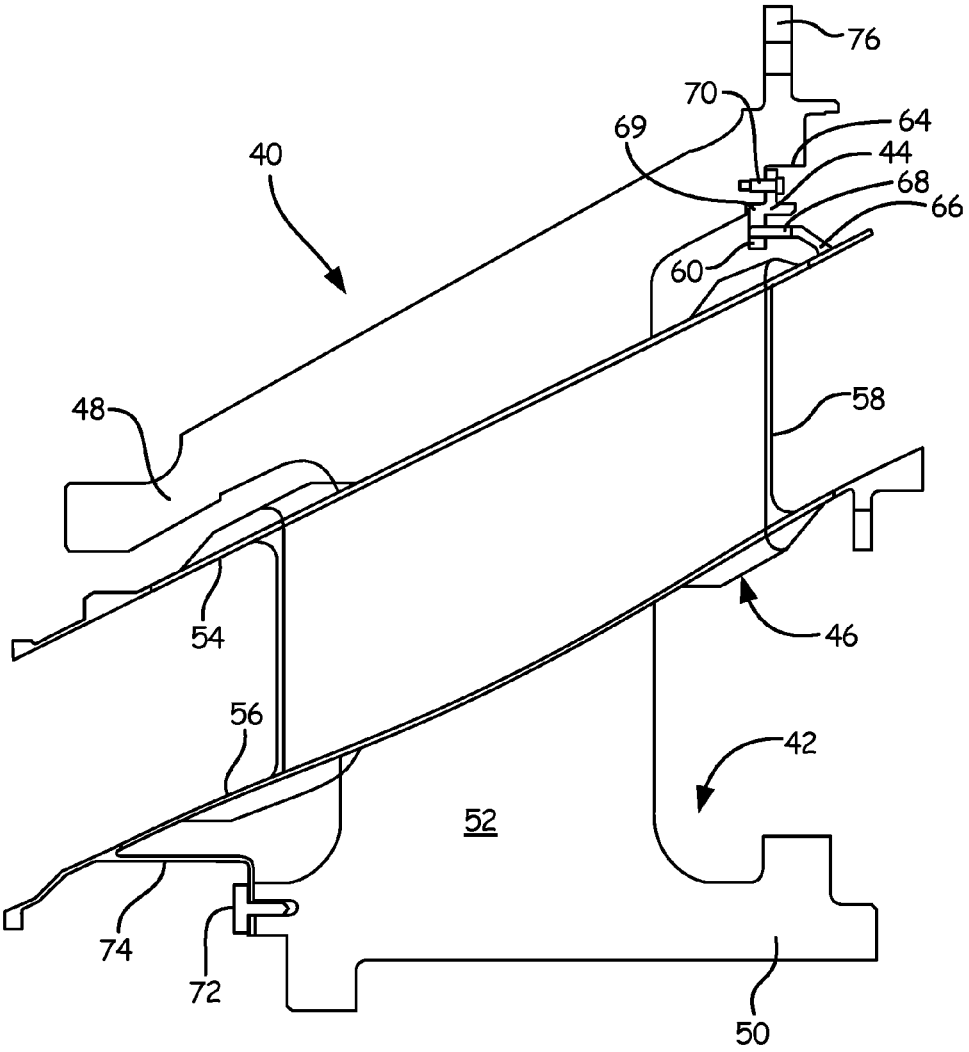
FIG. 3 is a cross-sectional view of the turbine exhaust case of FIG. 2A showing the fairing lining a flow path defined by the frame.

FIG. 3 shows a cross-section of LPTEC 40 having fairing 46 installed within frame 42 utilizing annular mount 44, which includes anti-rotation flange 60 and slots 62. Frame 42 includes outer ring 48, inner ring 50, strut 52 and counterbore 64. Fairing 46 includes outer ring 54, inner ring 56, vane 58. Outer ring 54 includes anti-rotation flange 66 with lugs 68. LPTEC 40 further comprises fasteners 70, fasteners 72 and mount ring 74.

Frame 42 comprises a structural, ring-strut-ring body wherein strut 52 is connected to outer ring 48 and inner ring 50. Frame 42 also includes other features, such as flange 77, to permit frame 42 to be mounted to components of gas turbine engine 10 (FIG. 1), such as low pressure turbine section 24, power turbine section 26 or an exhaust nozzle. Fairing 46 comprises a thin-walled, ring-strut-ring structure that lines the flow path through frame 42. Specifically, outer ring 54 and inner ring 56 define the boundaries of the actual annular flow path through TEC 40 for combustion gases 34 (FIG. 1). Vanes 58 intermittently interrupt the annular flow path to protect struts 52 of frame 42.

Mount ring 74 extends from inner ring 56 of fairing 46 and engages an axial end of inner ring 50 of frame 42. Mount ring 74 is connected via second fasteners 72 (only one is shown in FIG. 3). Fasteners 72 provide for axial, radial, and circumferential constraint of the axially forward portion of fairing 46 relative to frame 42. Thus, fairing 46 has a fixed connection (i.e., is radially, axially, and circumferentially constrained relative to the frame 42) to frame 42 at a first location. Flange 60, slots 62, flange 66 and lugs 68 engage to provide a floating connection for fairing 46 that permits axial and radial growth, but that prevents circumferential rotation.

Fairing 46 is designed to prevent exposure of frame 42 to heat from combustion gases 34 (FIG. 1). Depending on materials used, however, the temperature at frame 42 may rise to a level beyond what is desirable for the material of frame 42, even with the presence of fairing 46. In particular, radiant heat from fairing 46 may pass to frame 42. In the present disclosure, a heat shield is mounted between frame 42 and fairing 46 to inhibit heat transfer between fairing 46 and frame 42, thereby maintaining frame 42 at a desirable temperature. Specifically, the heat shield blocks all line-of-sight between frame 42 and fairing 46 to limit radiant heat transfer. As such, frame 42 can be made from a cost efficient material that is thermally protected by fairing 46 and the heat shield.

Figure 4:
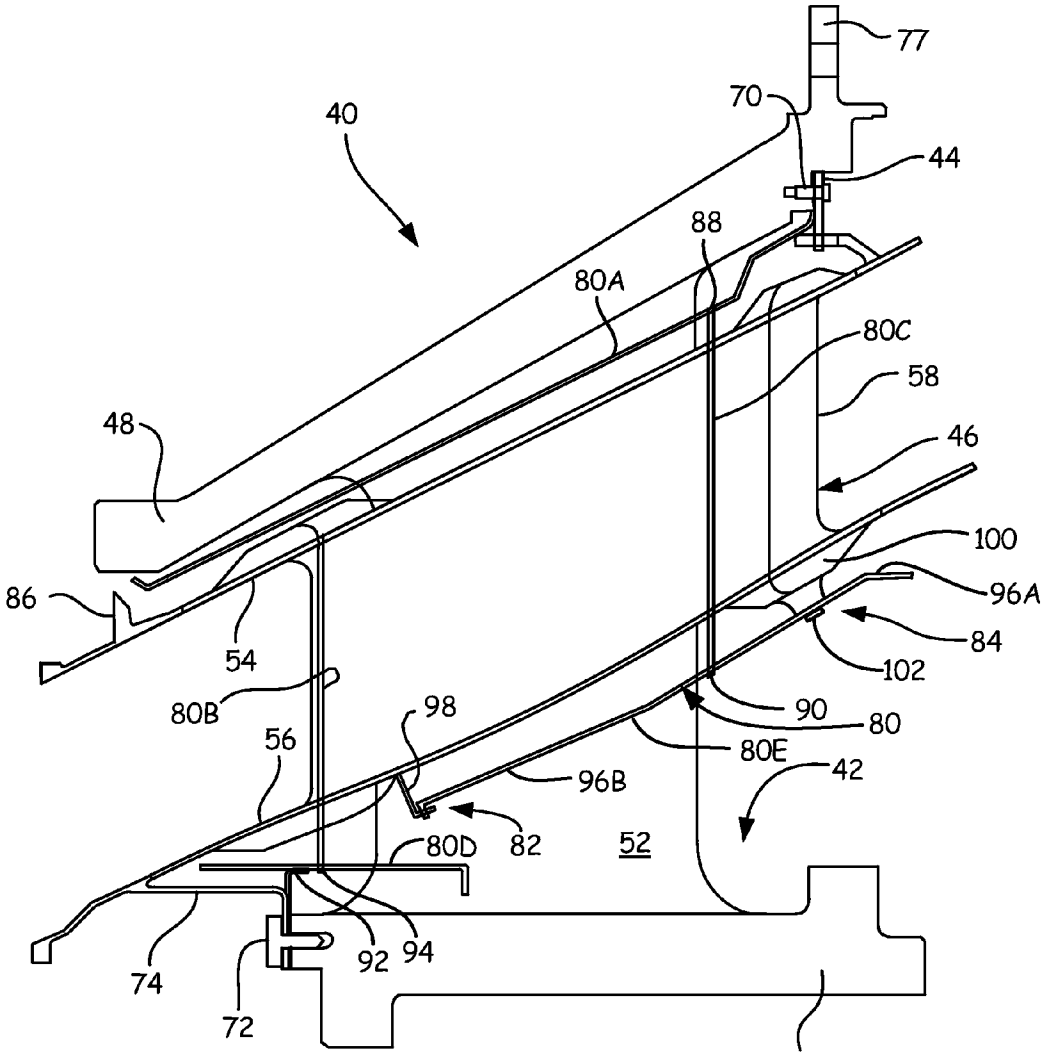
FIG. 4 is a cross-sectional view of the turbine exhaust case of FIG. 3 showing a heat shield that blocks all line-of-sight between the frame and the fairing.

FIG. 4 is a cross-sectional view of LPTEC 40 of FIG. 3 showing heat shield 80 coupled to fairing 46 using slip joint 82 and fixed joint 84. Heat shield 80 is segmented such that it comprises outer heat shield segment 80A, forward heat shield segment 80B, aft heat shield segment 80C and inner heat shield segments 80D and 80E. Frame 42 and fairing 46 include components and elements as are described with reference to FIGS. 1-3, and like reference numerals are used in FIG. 4. Heat shield 80 is positioned between frame 42 and fairing 46 to inhibit heat of gas flowing through fairing 46 from radiating to frame 42. Heat shield 80 comprises a plurality of thin-walled bodies that are coupled to frame 42 and fairing 46 at various junctures.

Outer heat shield segment 80A comprises a conical sheet positioned between outer ring 54 of fairing 46 and outer ring 48 of frame 42. Outer heat shield segment 80A includes openings to permit struts 52 to pass through. Outer heat shield segment 80A is joined to frame 42 using fastener 70. Fastener 70 passes through a bore within heat shield 80 and into a threaded bore within outer ring 48 at the juncture where annular mount 44 is joined to frame 42. Thus, heat outer heat shield segment 80A is fixed radially, axially and circumferentially via fastener 70. Outer heat shield segment 80A may also be fixed to fairing 46 at boss 86 using a threaded fastener as opposed to fastener 70.

Aft heat shield segment 80C is joined to outer heat shield segment 80A at joint 88. Aft heat shield segment 80C is also joined to inner heat shield segment 80E at joint 90. Aft heat shield segment 80C comprises a sheet metal body that is arcuate in the circumferential direction (e.g. "U" shaped) to partially wrap around strut 52. Joints 88 and 90 may comprise mechanical, welded or brazed joints. In other embodiments, aft heat shield segment 80C may be integrally formed with outer heat shield segment 80A and inner heat shield segment 80E. In another embodiment, forward and aft heat shields are affixed to vanes and are free from outer and inner heat shields.

Inner heat shield segment 80D comprises an annular sheet positioned between inner ring 56 of fairing 46 and inner ring 50 of frame 42. Inner heat shield segment 80D includes arcuate openings along its perimeter to permit struts 52 to pass through. Specifically, inner heat shield segment 80D includes a U-shaped cut-out along its trailing edge. Inner heat shield segment 80D is joined to frame 42 using fastener 72 and flange 92, which is joined to and extends radially inward from inner heat shield segment 80D. Fastener 72 passes through a bore within heat shield 80 and into a threaded bore within inner ring 50. Thus, inner heat shield segment 80D is fixed radially, axially and circumferentially via fastener 72 at one end and cantilevered at the opposite end.

Forward heat shield segment 80B is joined to inner heat shield segment 80D at joint 94. Forward heat shield segment 80B comprises a sheet metal body that is arcuate in the circumferential direction (e.g. "U" shaped) to partially wrap around strut 52. As such, forward heat shield segment 80B is configured to mate or overlap with aft heat shield segment 80C to fully enshroud strut 52. Forward heat shield segment 80B extends from joint 94 so as to be cantilevered within vane 58 of fairing 46 alongside strut 52. Forward heat shield segment 80B may, however, be joined to outer heat shield segment 80A. Joint 94 may comprise a mechanical, welded or brazed joint. In other embodiments, forward heat shield segment 80B may be integrally formed with inner heat shield segment 80D.

Inner heat shield segment 80E comprises a conical sheet positioned between inner ring 56 of fairing 46 and inner ring 50 of frame 42. Inner heat shield segment 80E includes arcuate openings along its perimeter to permit struts 52 to pass through. Specifically, inner heat shield segment 80E includes a U-shaped cut-out along its leading edge. Inner heat shield segment 80E extends between supported end 96A and unsupported end 96B. It thus becomes desirable to anchor heat shield 80 at additional locations other than those provided by fasteners 70 and 72 at frame 42. Slip joint 82 and fixed joint 84 provide mechanical linkages that couple heat shield 80 to fairing 46. Slip joint 82 includes anchor 98, which provides unsupported end 96B a limited degree of movement. Fixed joint 84 is rigidly secured to fairing 46 at pad 100 using fastener 102 to limit all degrees of movement of supported end 96A. In other embodiments, unsupported end of inner heat shield segment 80E may be joined to or integral with inner heat shield segment 80D.

In the disclosed embodiment, heat shield 80 is divided into a plurality of segments to facilitate assembly into LPTEC 40. Forward heat shield segment 80B is separated from outer heat shield segment 80A, and inner heat shield segments 80D and 80E are separated from each other. In other embodiments, inner heat shield segments 80D and 80E are joined together. Various examples of the construction of heat shield 80 are found in U.S. provisional patent application No. 61/747,237 to M. Budnick and U.S. provision patent application No. 61/747,239 to M. Budnick et al., both of which are assigned to United Technologies Corporation and are incorporated herein by reference. In other embodiments, heat shield 80 is a fully welded body such that there are no unsupported ends or separate segments of heat shield 80.

In any embodiment, heat shield 80 forms an obstruction between fairing 46 and frame 42. Radiant heat emanating from fairing 46 is inhibited from reaching frame 42. The radiant heat is either directly blocked or forced to travel a lengthier or more circuitous path than if heat shield 80 were not present. In one embodiment, heat shield 80 blocks all line-of-sight between frame 42 and heat shield 46 such that all radiant heat is inhibited in passing from fairing 46 to frame 42. That is, from any vantage point on frame 42, visibility of fairing 46 is obstructed by heat shield 80 in all directions. The presence of heat shield 80 allows for more flexibility in the design of LPTEC 40. Specifically, frame 42 may be fabricated, produced or made from a material having low temperature limitations, which generally provides for less expensive materials.

Figure 5:
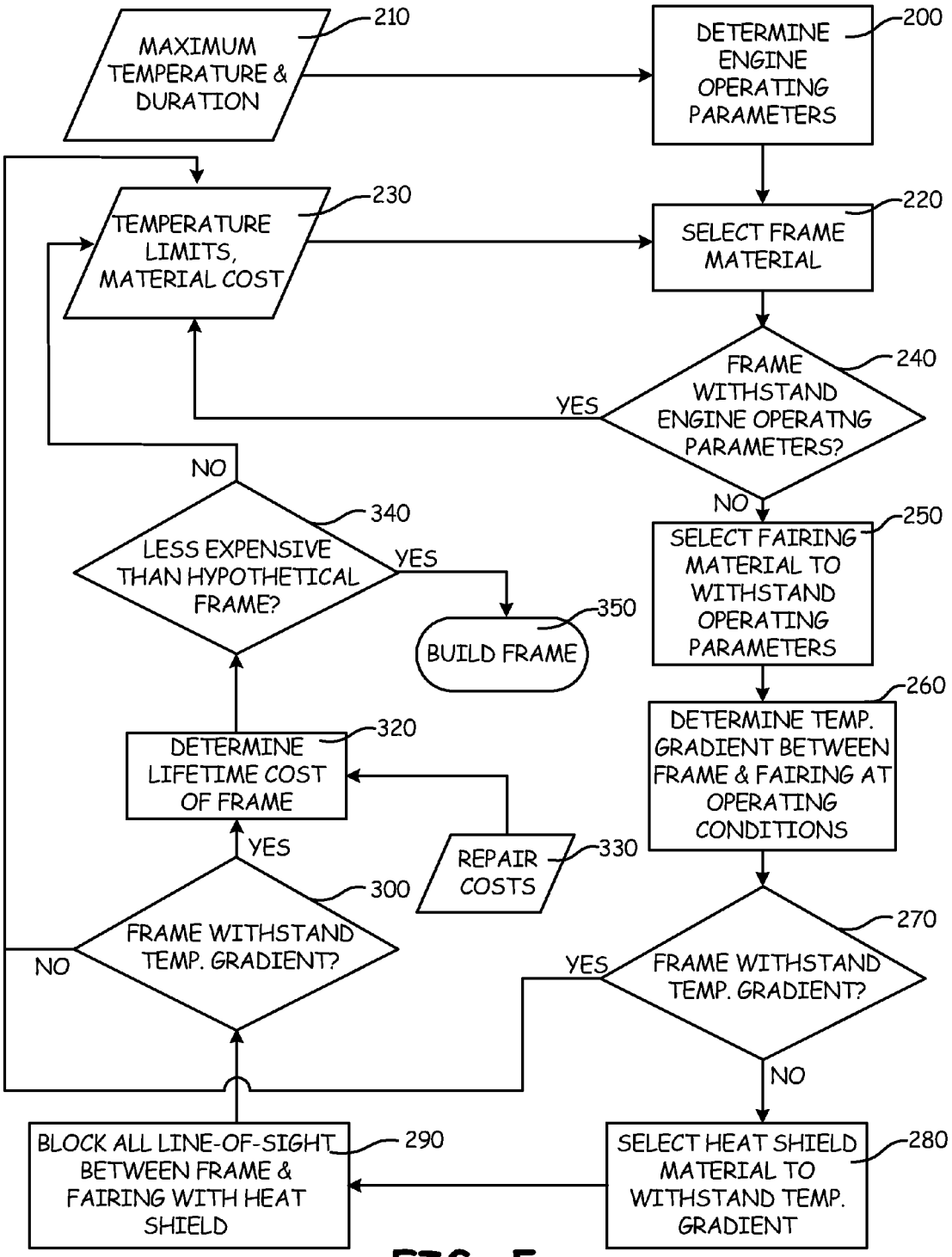
FIG. 5 is a flowchart diagramming a method of designing a turbine exhaust case including a frame, fairing and heat shield.

FIG. 5 is a flowchart diagramming a method of designing LPTEC 40 including frame 42, fairing 46 and heat shield 80. At block 200, operating parameters of engine 10 are determined. Using inputs from block 210, an engine operating element for the operating conditions is determined. The inputs include such factors as maximum engine operating temperatures and expected operating times for various operating conditions, such as take-off, cruise and landing. At block 220, a material for frame 42 is selected. Using inputs from block 230, a material is selected that provides desirable strength, weight, cost and performance benefits.

At block 240, a material is deliberately selected that cannot withstand the operating element of engine 10 in order to reduce the expense associated with frame 42. Generally, the cost of materials used in gas turbine engines, such as known super alloys, increases disproportionately with the maximum temperature the material is able to survive. Thus, it is desirable to have less expensive materials. If a material can withstand the engine operating parameters of block 200, a different, less expensive material that cannot withstand the engine operating parameters is selected at block 230. If the selected material cannot meet the engine operating temperatures, it is a candidate for use with frame 42. In one embodiment, frame 42 is produced from CA-6NM alloy, which is commercially available from Kubota Metal Corporation.

At block 250, the material for fairing 46 is selected. As discussed, it is desirable for fairing 46 to survive direct impingement of gases from gas turbine engine 10. Thus, fairing 46 is selected to have a temperature limit above the operating parameters determined at block 200. In one embodiment, fairing 46 is produced from Inconel® 625 alloy, which is commercially available from Special Metals Corporation.

At block 260, an expected temperature gradient between frame 42 and fairing 46 is determined, given the operating parameters determined at block 200. The temperature gradient provides an indication of the temperatures that frame 42 will be exposed to during operation of engine 10 when installed between frame 42 and fairing 46. Thus, at block 270, it is determined whether or not frame 42 can withstand the temperature gradient. It is an indication that frame 42 can be made from a cheaper material if frame 42 can survive the temperature gradient.

It is not feasible to simply provide frame 42 with a coating that, while still saving cost over a more expensive frame alloy, increases the temperature limitations of frame 42. Specifically, the application of known thermal barrier coatings can require temperatures that exceed the temperature limits of cost-effective base materials for frame 42. Additionally, it is not practical to provide overcooling to frame 42 by flowing increased amounts of cooling air, such as from low pressure compressor section 16 (FIG. 1), between frame 42 and fairing 46. Such a method imposes significant performance and efficiency penalties in gas turbine engine 10. Thus, such a solution is undesirable. Thus, a different, cheaper material for frame 42 can be selected at block 220 if frame 42 can withstand the temperature gradient at block 270.

If frame 42 cannot withstand the temperature gradient at block 270, a material for a heat shield is selected at block 280. The temperature gradient determined at block 260 provides an indication of the temperatures that heat shield 80 will be exposed to when installed between frame 42 and fairing 46. The material for heat shield 80 is selected to withstand the temperature gradient at block 280. In one embodiment, heat shield 80 is produced from Inconel® 625 alloy, which is commercially available from Special Metals Corporation.

At step 290, heat shield 80 is designed to block all line-of-sight between frame 42 and fairing 46 to interrupt all radiant heat transfer and reduce the thermal exposure of frame 42. At step 300, the material of frame 42 is checked to determine if it can survive the temperature gradient between frame 42 and fairing 46 given the presence of heat shield 80. If frame 42 cannot withstand the temperature gradient, a new frame material must be selected at step 220 using higher temperature limits. If frame 42 can withstand the temperature gradient, the lifetime cost of frame 42 is determined at block 320.

At block 320, using input from block 330, the material selected for frame 42 is checked to verify that the long-term repair costs of frame 42 do not outweigh the short-term cost savings of the material selected at block 220. For example, given the determined operating parameters at block 200, the expected overall life of frame 42 for the selected material is determined. The overall life of frame 42 includes the total number of repair or refurbishment processes frame 42 is expected to undergo during its life, and the cost of each process.

At block 340, the overall life of frame 42 with the selected, less expensive material is compared to the overall life of frame 42 if produced from a more expensive material having a temperature limit that can withstand the operating element selected at block 200. If the total number of frames 42 made from the less expensive material, including all repair and refurbishment processes, is less expensive than the cost of a single frame of more expensive material, then the material can be used to build frame 42 at block 350. If the material for frame 42 selected at block 220 does not provide a long term cost savings, a different, less expensive material is selected at block 220.

LPTEC 40 designed according to the method of the present disclosure provides significant cost savings over the use of more expensive super alloys for frame 42. As discussed above, the initial material cost of frame 42 and the associated repair costs is less than the cost of a hypothetical frame capable of withstanding temperatures of engine 10 without the use of a heat shield. The use of heat shield 80 allows engine 10 to realize other performance benefits. For example, less cooling air can be provided between fairing 46 and frame 42, as opposed to LPTEC designs not having a heat shield.

Discussion of Possible Embodiments

The following are non-exclusive descriptions of possible embodiments of the present invention:

A turbine exhaust case comprising: a frame fabricated from a material having a temperature limit below an operating point of a gas turbine engine, the frame comprising: an outer ring; an inner ring; and a plurality of struts joining the outer ring and the inner ring; a fairing fabricated from a material having a temperature limit above the operating point of the gas turbine engine, the fairing comprising a ring-strut-ring structure that lines the flow path; and a heat shield disposed between the frame and the fairing to inhibit radiant heat transfer between the frame and the fairing.

The turbine exhaust case of the preceding paragraph can optionally include, additionally and/or alternatively, any one or more of the following features, configurations and/or additional components:

A heat shield that blocks all line-of-sight between the fairing and the frame.

A heat shield that comprises a ring-strut-ring structure.

A heat shield that is fabricated from a material having a temperature limit higher than that of the frame.

A frame that is fabricated from CA-6NM alloy.

A heat shield that is fabricated from Inconel 625 alloy.

A fairing that is fabricated from Inconel 625 alloy.

A turbine structural case comprises: a frame produced from CA-6NM alloy, the frame comprising: an outer ring; an inner ring; and a plurality of struts joining the outer ring and the inner ring to define a load path between the outer ring and the inner ring.

The turbine structural case of the preceding paragraph can optionally include, additionally and/or alternatively, any one or more of the following features, configurations and/or additional components:

A fairing comprising a ring-strut-ring structure that defines a flow path within the load path.

A heat shield disposed between the frame and the fairing to inhibit heat transfer between the frame and the fairing.

A heat shield and fairing that are fabricated from materials having higher temperature limits than CA-6NM alloy.

A heat shield that blocks all line-of-sight between the fairing and the frame.

A heat shield that forms a barrier to all radiant heat capable of emanating from the frame toward the fairing.

A method for designing a case structure including a heat shield that is disposed between a frame and a fairing, the method comprising: determining a temperature element of an engine operating point for a gas turbine engine; selecting a frame material not capable of withstanding the temperature element; selecting a fairing material capable of withstanding the temperature element; determining a temperature gradient between the fairing and the frame at the operating point; and selecting a heat shield material having a shield temperature limit capable of withstanding the temperature gradient.

The method of the preceding paragraph can optionally include, additionally and/or alternatively, any one or more of the following features, steps, configurations and/or additional components:

A frame material that is selected for being less expensive than a material capable of withstanding the temperature element.

Repair costs of the frame over a service life of the frame are less expensive than initial cost of a frame produced from a material capable of withstanding the temperature element.

A frame material is CA-6NM alloy.

A temperature element that is a function of maximum operating temperature of the gas turbine engine and time.

Developing a heat shield that blocks all line-of-sight between the frame and the fairing.

A heat shield that forms a barrier to all radiant heat that emanates from the frame toward the fairing.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine exhaust case comprising:

a frame fabricated from a material having material properties that enable the frame to support at least a portion of a gas turbine engine below an operating temperature of the gas turbine engine but not at or above the operating temperature of the gas turbine, the frame comprising:

an outer ring;

an inner ring; and a plurality of struts joining the outer ring and the inner ring;

a fairing fabricated from a material having material properties enabling the fairing to operate above the operating temperature of the gas turbine engine, the fairing comprising a ring-strut-ring structure that lines the flow path; and a heat shield disposed between the frame and the fairing to inhibit radiant heat transfer between the frame and the fairing, wherein the heat shield comprises:

a first inner heat shield positioned between the fairing and the inner ring, wherein the inner heat shield is attached to the inner ring of the frame; and a second inner heat shield positioned between the fairing and the inner ring, wherein the second inner heat shield is attached to the fairing to restrain the second inner heat shield, wherein the first and second inner heat shields are spaced from each other.

2. The turbine exhaust case of claim 1 wherein the heat shield blocks all line-of-sight between the fairing and the frame.

3. The turbine exhaust case of claim 1 wherein the heat shield is fabricated from a material having material properties enabling the heat shield to operate within the gas turbine engine at a higher temperature than that of the frame.

4. The turbine exhaust case of claim 1 wherein the frame is fabricated from CA-6NM alloy.

5. The turbine exhaust case of claim 1 wherein the heat shield is fabricated from Inconel 625 alloy.

6. The turbine exhaust case of claim 1 wherein the fairing is fabricated from Inconel 625 alloy.

7. The turbine exhaust case of claim 1, wherein:

the heat shield further comprises:

a forward heat shield extending radially from the inner heat shield to partially enclose one of the plurality of struts;

an outer heat shield positioned between the fairing and the outer ring of the frame; and an aft heat shield extending from the second inner heat shield to the outer heat shield, wherein the aft heat shield is joined to the second inner heat shield and the outer heat shield.

8. The turbine exhaust case of claim 7, wherein the second inner heat shield extends towards the first inner heat shield from a fixed joint to a sliding joint, and wherein the fixed joined restrains the second inner heat shield relative to the fairing and the sliding joint permits the second inner heat shield to move in at least one direction relative to the fairing.

9. The turbine exhaust case of claim 7 wherein the heat shield forms a ring-strut-ring structure.

10. A turbine structural case comprising:

a frame produced from CA-6NM alloy, the frame comprising:

an outer ring;

an inner ring; and a plurality of struts joining the outer ring and the inner ring to define a load path between the outer ring and the inner ring;

a fairing comprising a ring-strut-ring structure that defines a flow path within the load path; and a heat shield disposed between the frame and the fairing to inhibit heat transfer between the frame and the fairing, wherein the heat shield comprises:

a first segment attached to the inner ring; and a second segment attached to the fairing, wherein the first and second segments are spaced from each other, and wherein the first and second segments are positioned between the fairing and the inner ring.

11. The turbine structural case of claim 10 wherein the heat shield and the fairing are fabricated from materials having material properties that enable use of the heat shield and fairing within the gas turbine engine at a higher temperature than CA-6NM alloy.

12. The turbine structural case of claim 10 wherein the heat shield blocks all line-of-sight between the fairing and the frame.

13. The turbine structural case of claim 10 wherein the heat shield forms a barrier to all radiant heat capable of emanating from the fairing toward the frame.

14. A method for designing a case structure including a heat shield that is disposed between a frame and a fairing, the method comprising:

determining a temperature of an engine operating point for a gas turbine engine;

selecting a frame material capable of supporting at least a portion of the gas turbine engine below the temperature but not at or above the temperature;

selecting a fairing material capable of operating within the gas turbine engine above the temperature;

determining a temperature gradient between the fairing and the frame at the engine operating point;

selecting a heat shield material capable of operating within the gas turbine engine when exposed to the temperature gradient;

building a case structure comprising:

a frame constructed from the frame material;

a fairing constructed from the fairing material; and a heat shield constructed from the heat shield material; and joining a first segment of the heat shield to an inner ring of the frame; and joining a second segment of the heat shield to the fairing such that the second segment is spaced from the first segment of the heat shield, wherein the first and second segments are positioned between the fairing and the inner ring.

15. The method of claim 14 wherein the frame material is selected for being less expensive than a material capable of withstanding the temperature.

16. The method of claim 15 wherein repair costs of the frame over a service life of the frame are less expensive than initial cost of a frame produced from a material capable of withstanding the temperature.

17. The method of claim 14 wherein the frame material is CA-6NM alloy.

18. The method of claim 14 wherein the temperature is a function of maximum operating temperature of the gas turbine engine and time.

19. The method of claim 14 and further comprising:

developing a heat shield that blocks all line-of-sight between the frame and the fairing.

20. The method of claim 14 wherein the heat shield forms a barrier to all radiant heat that emanates from the fairing toward the frame.

* * * * *